US005495739A

United States Patent [19]

Beecher

[11] Patent Number: 5,495,739

[45] Date of Patent: Mar. 5, 1996

[54] APPARATUS FOR FORMING SCROLLS FROM STRIP MATERIAL

[76] Inventor: Roy Beecher, 88 Low Road, Thornhill Edge, Dewsbury, W. Yorks, England

[21] Appl. No.: 204,377

[22] PCT Filed: Jul. 24, 1992

[86] PCT No.: PCT/GB92/01380

§ 371 Date: Mar. 11, 1994

§ 102(e) Date: Mar. 11, 1994

[87] PCT Pub. No.: WO93/05899

PCT Pub. Date: Apr. 1, 1993

[30] Foreign Application Priority Data

| | | | |
|---|---|---|---|
| Sep. 13, 1991 | [GB] | United Kingdom | 9119549 |
| Mar. 7, 1992 | [GB] | United Kingdom | 9204989 |

[51] Int. Cl.[6] ..... B21C 47/00

[52] U.S. Cl. ..... 72/146; 72/147; 72/148

[58] Field of Search ..... 72/138, 146, 147, 72/148, 358; 140/92.2

[56] References Cited

U.S. PATENT DOCUMENTS

| | | | |
|---|---|---|---|
| 805,231 | 11/1905 | Pembroke | 72/147 |
| 2,406,130 | 8/1946 | Boyce | 140/92.2 |
| 2,479,391 | 8/1949 | Miller | 140/92.2 |
| 3,020,949 | 2/1962 | Garcia | 72/147 |
| 3,420,080 | 1/1969 | Supina et al. . | |
| 3,538,736 | 11/1970 | Nyren . | |
| 3,580,018 | 5/1971 | Gott | 72/338 |
| 4,351,175 | 9/1982 | Ichikawa et al. | 72/338 |

FOREIGN PATENT DOCUMENTS

| | | |
|---|---|---|
| 7001488 | 10/1971 | France . |
| 7107912 | 10/1972 | France . |
| 7422345 | 1/1976 | France . |
| 1216860 | 12/1970 | United Kingdom . |

*Primary Examiner*—Lowell A. Larson
*Assistant Examiner*—Rodney A. Butler
*Attorney, Agent, or Firm*—Zarley, McKee, Thomte, Voorhees, & Sease

[57] ABSTRACT

The invention provides that a former (A,B,C) is used for forming scrolls from strip metal (30). The former has a scroll flight which is in two parts (A,B) which are relatively movable in the direction of the axis about which the former (A,B,C) rotates to coil the strip (30) about the flight (A,B) by drawing it radially into the former. In the first stage of the process the strip (30) is coiled about the inner part (A) of the flight, the outer part (B) being held displaced axially so as not to interfere with the initial coiling by the strip (30), until the strip (30) clears the end of the outer part (B) of the flight which then move into the plane of the inner part (A) of the flight and coiling can continue onto the outer part (B). The apparatus can also, in selected embodiments, include additional mechanisms for making circles and arches from the strip and for cutting, punching, twisting and right angle bending the strip from the same drive.

17 Claims, 7 Drawing Sheets

APPARATUS FOR FORMING SCROLLS FROM STRIP MATERIAL

This invention relates to an apparatus for forming scrolls from strip material. Such scrolls are utilised for example in decorative iron work for gates, fences, windows, ornaments and the like.

Scrolls are typically formed from metal strip or bar which is initially straight, but which is inserted into a jig and coiled resulting in the formation of the scroll. If a scroll is to turn through only a single revolution, or 360°, then the design and construction of the jig is quite simple, but if, as is more usual, the scroll is to turn through more than one revolution, and a scroll in the order of two revolutions is perhaps the most common, then the design and construction of the jig is much more difficult. This occurs because the part of the scroll which enables the formation of the second revolution prevents the strip from being inserted into the part of the scroll which forms the first revolution. In consequence, scroll jigs for forming scrolls of more than one revolution have had to be specially adapted and various forms are now in use.

In a first form, the scroll is in two parts for forming the respective revolutions, and the second part is detachable from a support plate which holds the first part. The first revolution of the scroll is formed on the first part with the second part removed, and following formation of the first revolution of the scroll, the second part of the scroll jig is put in place, and the scroll forming continues.

In another construction, the scroll jig is again in two parts, being a fixed part to form the first revolution of the scroll, and a second part which is hinged to the first part and can be hinged out of the way whilst the first revolution of the scroll is being formed. The second part of the jig swings into position after completion of the first revolution of the scroll, and then is utilised for the formation of the remainder of the scroll.

In yet a further arrangement, the scroll jig has the inner part of the scroll jig which forms the first revolution of the scroll higher than the remainder, and the jig has an edge which gradually tapers from the higher part to the lower part so that the metal strip as it is being formed into a scroll, progressively runs down the support edge whereby a scroll of more than one revolution can be formed on a single jig. The scroll so formed however as well as defining a spiral also takes up a slightly conical form, and it must be flattened in order to complete the scrolling operation. It is not suitable for scrolling relatively heavy gauge material.

The present invention seeks to provide another form of scroll forming apparatus which is particularly convenient in use in that it does not require scroll jig parts to be detached or to be pivotally interconnected and yet enables the formation of multiple turn scrolls which do not require subsequent flattening but wherein the scrolls can be formed in a continuous operation.

In accordance with the invention in one aspect thereof, scroll forming apparatus comprises a scroll forming jig comprising at least a first part and a second part, said first part enabling a formation of a first revolution of the scroll, and the second part enabling a formation of a second revolution of the scroll, said first and second parts being axially displaced relative to the axis of rotation as the first revolution of the scroll is formed, and being such that upon completion of at least a part of said first revolution, either the partly formed scroll is moved axially relative to the second part of the jig, or the second part of the jig is moved axially relative to the scroll whereby at least a part of the second revolution of the scroll can be formed on said second part of the jig and in the same plane as the first revolution of the scroll.

The said scroll jig may comprise an inner scroll part and an outer scroll part which are connected at a shoulder or step, or preferably, the scroll jig is in two parts which are relatively axially displaceable on the axis about which the strip is rotated in forming the scroll. The said two parts may be spring loaded so as initially to lie in the same plane, but the outer part being displaceable against spring action to enable the strip to be formed into the scroll in a inner revolution, the second part being held displaced from the first part by the edge of the strip as the inner revolution is being formed, so that automatically upon completion of the formation of at least part of the inner revolution, the second part of the scroll is displaced by the spring action into operative position to enable at least part of the second revolution of the scroll to be formed in a continuous motion.

Relative rotation of the strip and scroll jig may take place in any convenient manner. For example the jig may be mounted for rotation about a horizontal axis, and a handle, crank or power transmission may be used for the rotation of the scroll jig, whilst the strip is inserted and held therein. In a preferred embodiment a ratchet means may be used to rotate the scroll, this is particularly advantageous since it safeguards against slippage or reverse motion of the scroll when the scroll is used. The front end of the strip may be adapted to be clamped in the inner part of the scroll jig by a suitable clamping means. Such clamping means preferably comprises an adjustable gripping member for gripping variable thicknesses of strip or bar and a stop member which determines in which portion of the scroll face the strip or bar is loaded.

Where the jig is power driven any suitable prime mover may be utilised.

Instead of the jig parts being spring loaded there may be adapted to be moved by hand, or drive means (e.g. an electromagnet) or gravity, by suitable arrangement of the parts.

The invention also provides for a plurality of scroll forming jigs mounted in aligned relationship along the length of a rotating shaft such that a plurality of strips or bars can be formed in unison.

It will be seen that the scroll forming apparatus provides an effective and convenient means for the rapid formation of scrolls in metal strip and such scrolls when formed do not require subsequent flattening.

According to a further aspect of the invention there is provided a fitting for a scroll forming apparatus comprising at least two spaced supporting members adapted to urge a strip or bar against the outer rim of a scroll forming member so that a deforming pressure can be applied to the strip or bar and wherein the relative angle between the two supporting members can be adjusted so as to correspondingly vary the angle that the strip or bar subtends the outer rim of the scroll forming member so as to produce a curved strip or bar of predetermined shape when either or both the scroll or said members rotate with respect to each other.

According to yet a further aspect of the invention there is provided a scroll forming apparatus comprising a first clamping means axially projecting with respect to the angle of rotation of the scroll and a second fixedly aligned spaced clamping means whereby a strip or bar can be clamped between the two clamping means and rotation of the scroll brings about twisting of the strip or bar.

According to a preferred feature of this invention the guiding of strip material into the scroll forming means is improved to allow a scroll of improved finish to be produced using the apparatus.

The current invention provides guide means for use with a scroll forming apparatus comprising a scroll forming jig comprising at least two axially mounted parts said first part enabling a formation of a first revolution of the scroll, and according to this preferred feature a guide means is provided to allow the strip material to be supplied to the scroll forming jig wherein said guide means includes a movable member mounted adjacent to said scroll forming jig and movable between a first position close to said first part of the jig when the first revolution of the scroll is being formed, and a second position outwardly of said first position when the second part of the scroll is being formed.

The guide means may comprise a trigger plate shaft of the apparatus, the rotation of said trigger plate being limited by adjustable stops.

Preferably, said trigger plate provides reactive support for the strip material as it is being supplied to the scroll jig.

Preferably, the trigger plate is adapted to be moved to the said second position by the said trigger plate coming into contact with the second jig part after it has been moved axially into the same plane as the first scroll jig part. Preferably said guide trigger plate has a trigger projection which engages the second scroll jig part as it is rotated during the scroll forming to move the trigger plate to its second position. The trigger plate preferably is rotatably mounted off centre so that in moving from the first to the second position it will pass through an overcentre point thereby ensuring that it cannot freely return to the first position.

The invention also provides a more general aspect in that heretofore, all scroll formers for decorative ironwork have been constructed and arranged to operate on the basis of manual wrapping of the strip around the scroll former, the axis of the scroll former being disposed in a vertical configuration.

The general aspect of the invention resides in that apparatus for forming a strip of material into scroll shape comprises a scroll former mounted for rotation about a horizontal axis and adapted to receive the strip presented radially relative to said axis, and including drive means for rotating the scroll former.

By this means a new approach to scroll forming is provided. There is no manual wrapping of the strip around the former, but rather the strip is drawn into the scroll former or it is rotated by the drive means, which may be operated by manual or motive power input.

By using radial infeed of the strip, rather than wrapping it round a former, scroll forming can be performed particularly easily and it is easy to guide the strip as it is drawn into the scroll former, for example in the manner hereinbefore set forth.

In yet a further aspect of the invention a multiple function machine for strip working is provided wherein the machine comprises a scroll former for forming a strip of material into scroll shape and drive means for rotating the scroll former so that forming takes place by feeding the strip radially of the rotating former, and wherein the machine includes at least one other mechanism, driven by the same drive means for the right angle bending, arcuate bending, guillotining, hole punching or riveting of the strip material. The riveting section of the machine could be adapted for providing small decorative pressings from small metal plates.

Preferably there are at least two of said other mechanisms.

An embodiment of the present invention will now be described, by way of example, with reference to the accompanying diagrammatic drawings, wherein.

Figure 1:
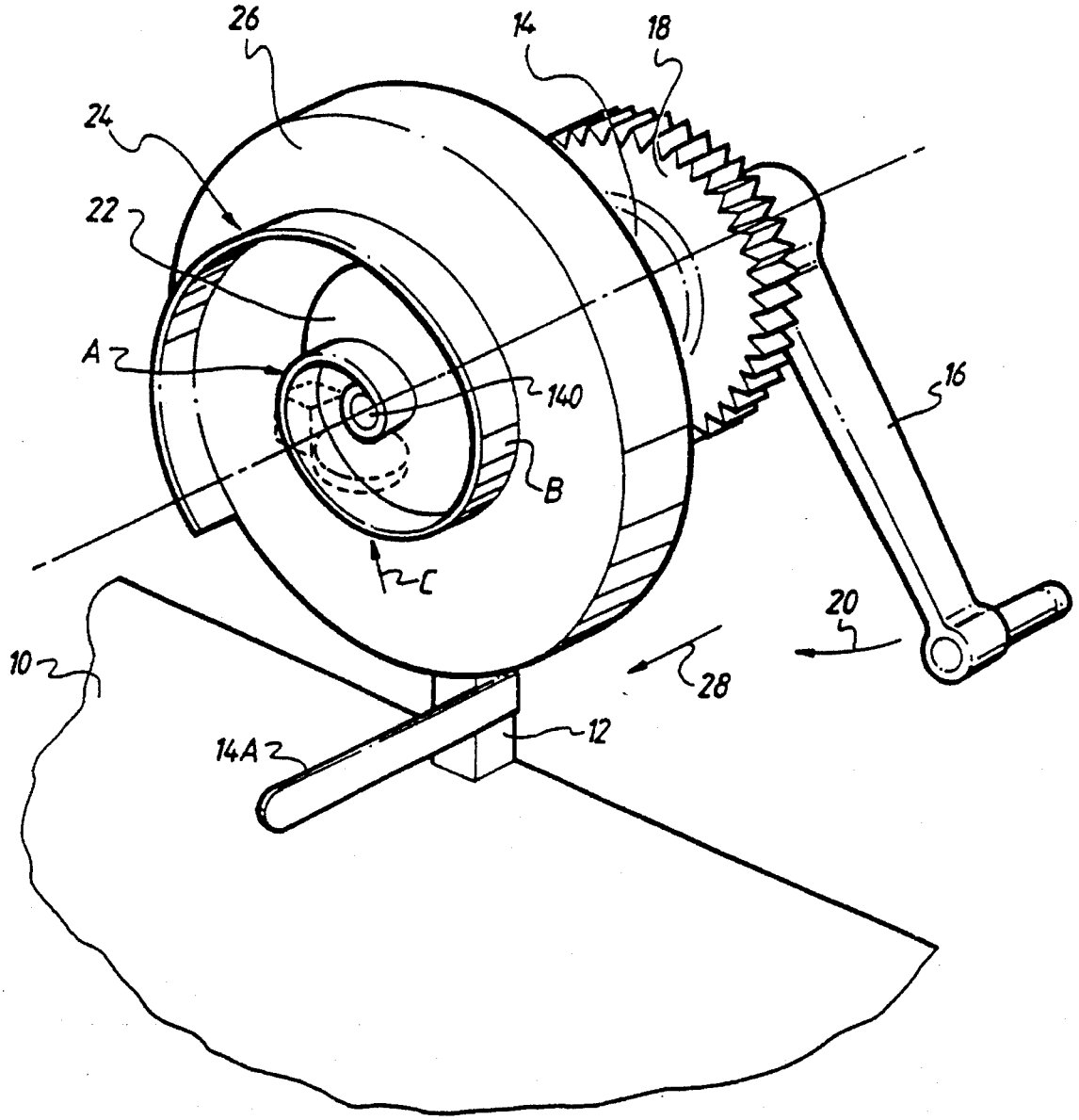
FIG. 1 is a perspective view of the apparatus according to the embodiment of the invention, in a rest position.
Figure 2:
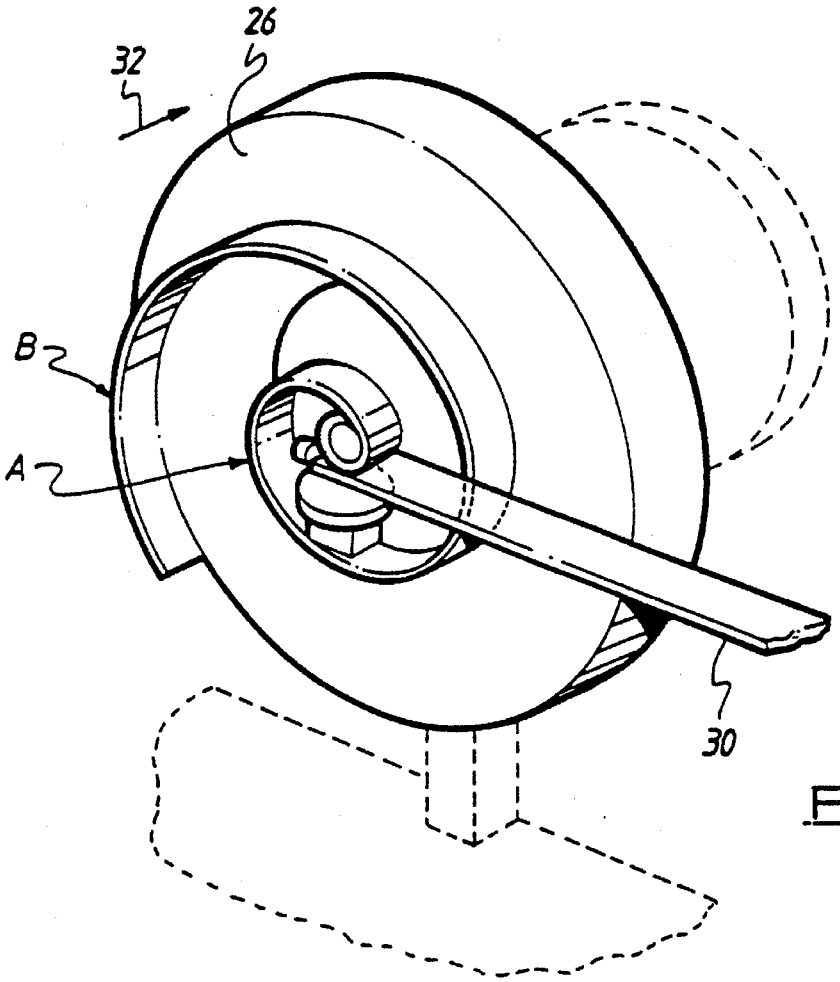
FIG. 2 is a view similar to FIG. 1 but showing the apparatus in the initial operational position when a strip has been inserted for being formed into a scroll.
Figure 8:
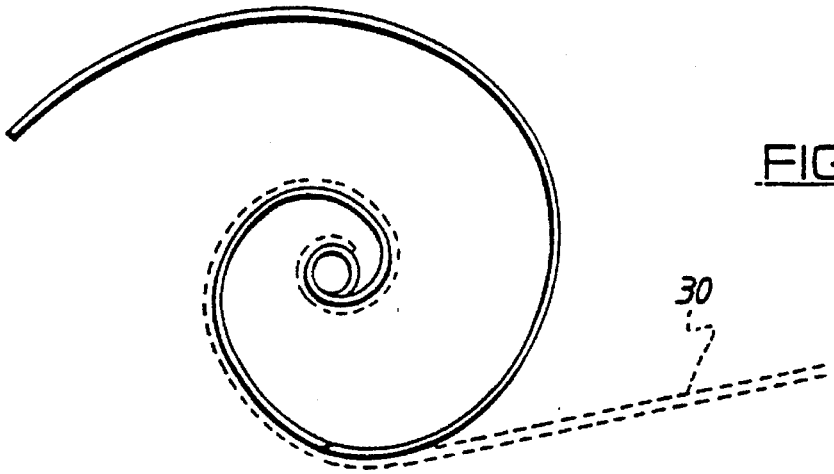
Figure 9:
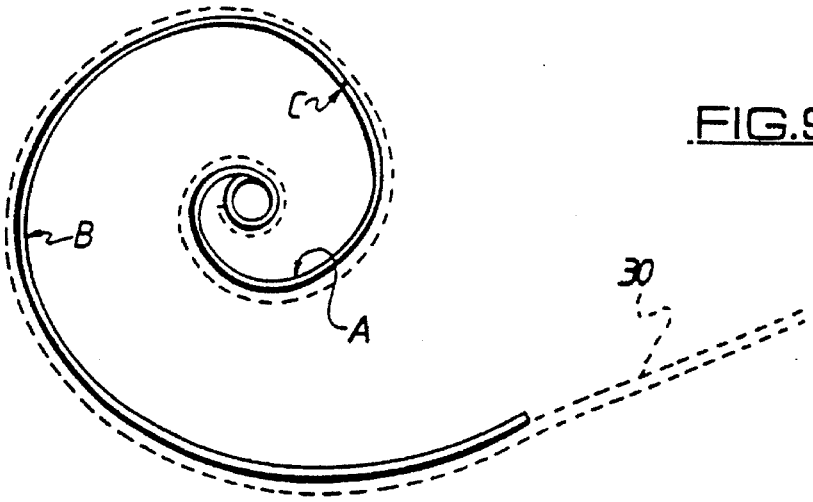
Figure 10:
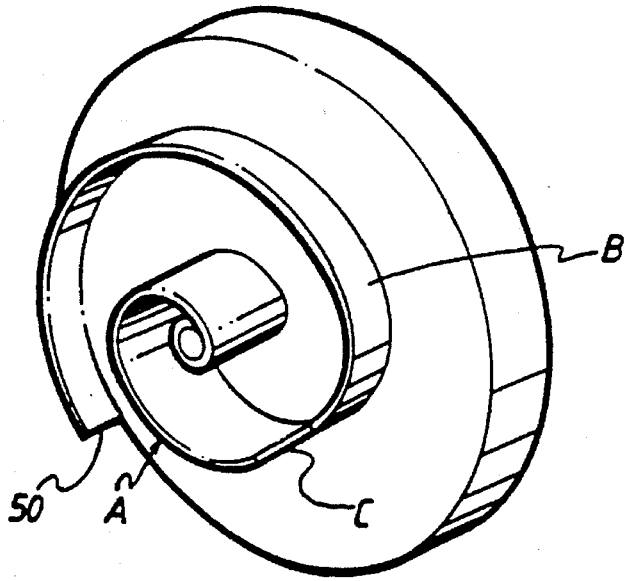
Figure 11:
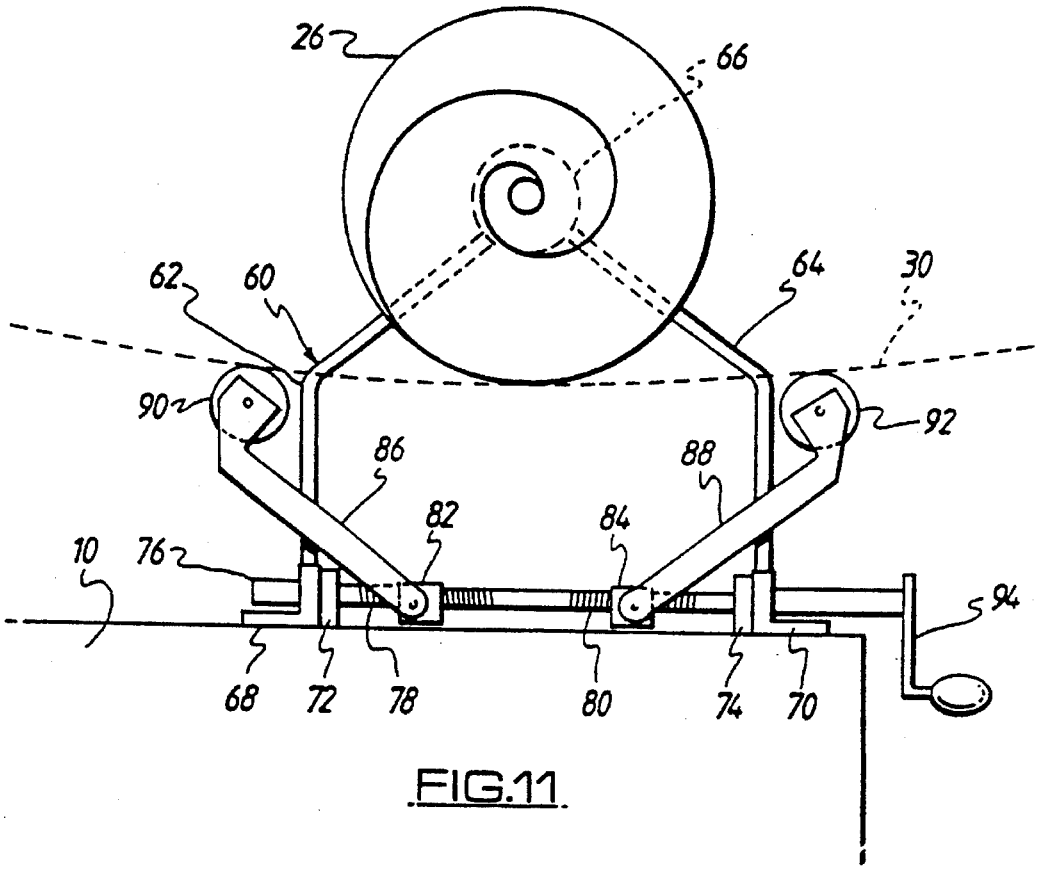
Figure 12:
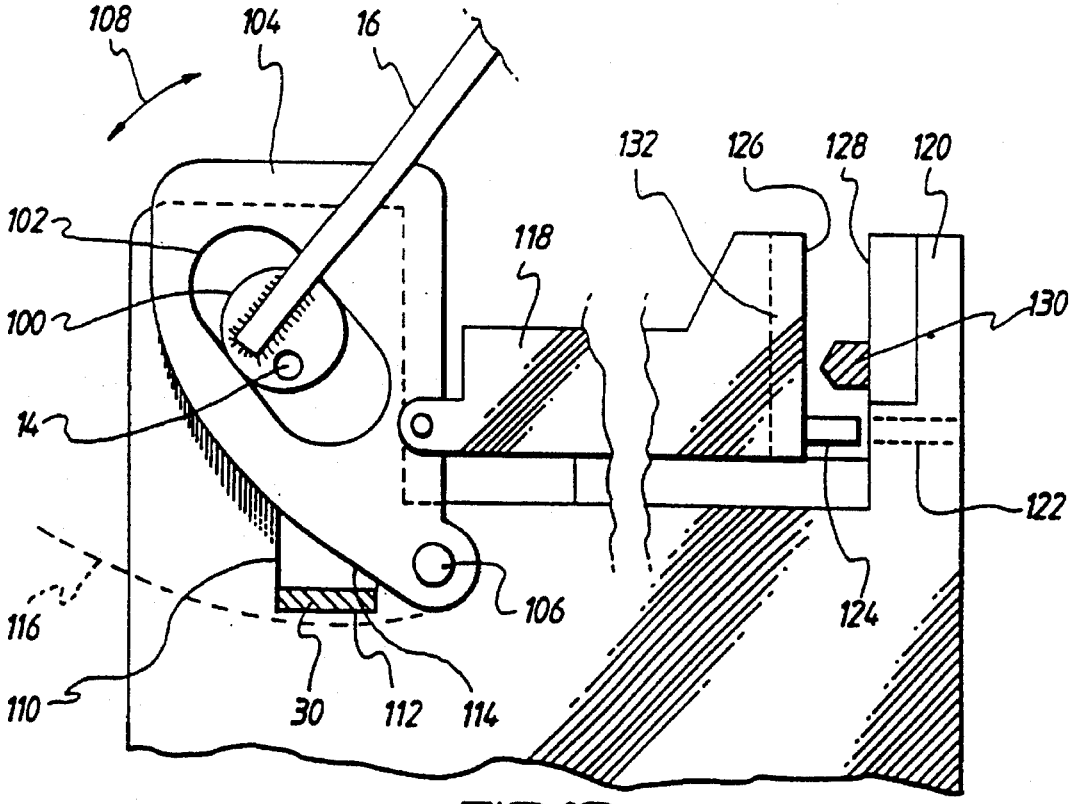
Figure 13:
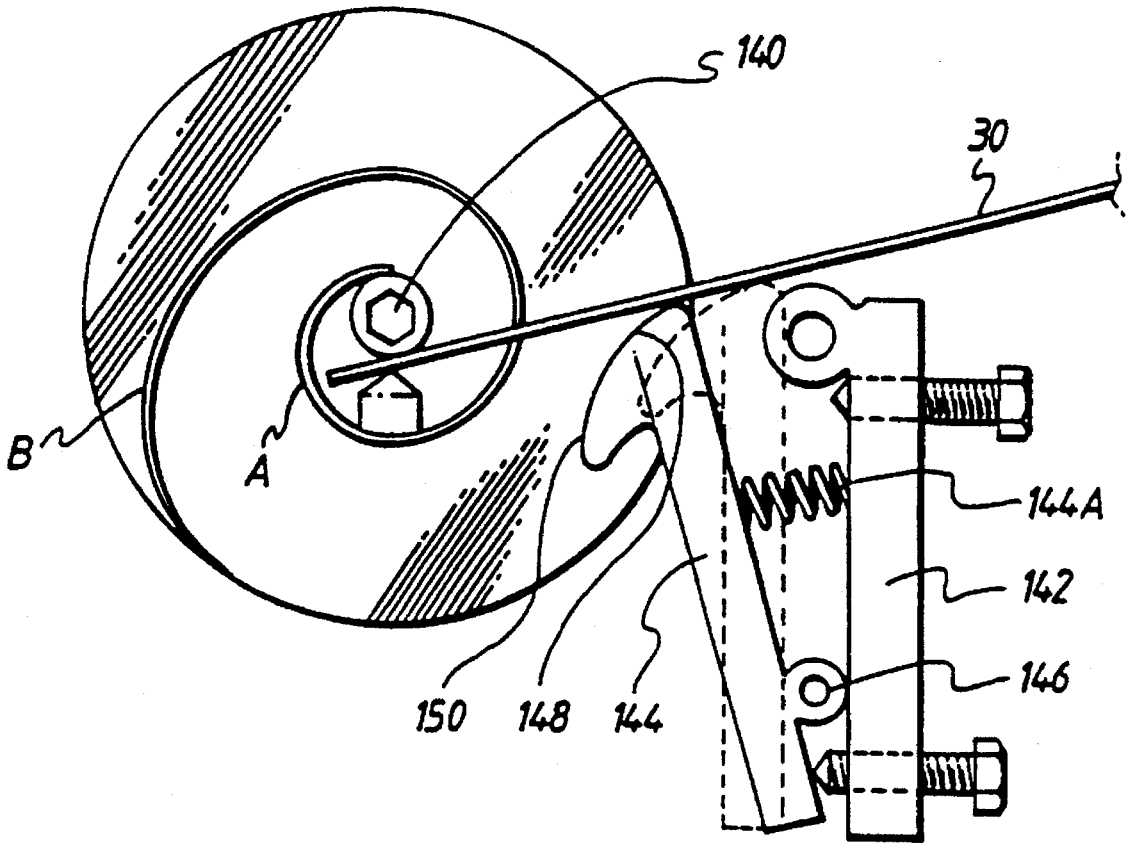

FIGS. 5–9 so in a series of steps how the scroll is formed using the apparatus of FIGS. 1 and 2;

FIG. 10 illustrates a modified form of scroll jig for forming a scroll similar to the method illustrated in FIGS. 5–9;

FIG. 11 is a side view of the apparatus of FIG. 1 when fitted with an arch and circular forming device;

FIG. 12 is a side view of the apparatus of FIG. 1 when fitted with a mechanism for riveting, punching and right angle forming of strip material; and FIG. 13 is a side view of the apparatus of FIG. 1, with a pressure applying device fitted thereto.

Referring to the drawings, and firstly to FIG. 1, the apparatus for forming scrolls in metal strip or bar comprises a base 10 which may be part of a table or stand or the like, and a pedestal 12 extending upwardly from the base. The pedestal 12 supports a rotatable shaft 14 which in this example is rotatable manually by means of a crank handle 16. The crank handle may comprise a square drive pin which fits in a corresponding recess in the end of the shaft 14 so that the handle is removable. In this example a ratchet wheel 18 integral with the shaft 14 is engaged by a pawl in order to prevent the shaft from rotating in what will be referred to as the reverse direction. The shaft can be rotated by the handle 16 in the forwards direction indicated by arrow 20 for the formation of the scroll in the metal strip.

A disc 22 is fast with shaft 14 at the end of the shaft remote from the handle 16, and the disc 22 has secured thereon the first part A of a scroll jig 24 and the other part B of which is carried by a disc 26 which is slidably carried by the shaft 14, but is urged by a compression spring (not shown) forwardly as indicated by the arrow 28 in FIG. 1. The disc 22 limits the extent to which the disc 26 can move forwards so that when the disc 26 is in the forwards limiting position, the two parts A and B of the scroll jig 24 are in the same plane.

Further pedestal 12 supports a guide 14A which in this example comprises a bar. But in an alternative example a guide clamp comprising adjustably spaced rollers or plates may be provided so that as the strip or bar passes through the rollers the strip or bar is flattened prior to scrolling.

Figure 2A:
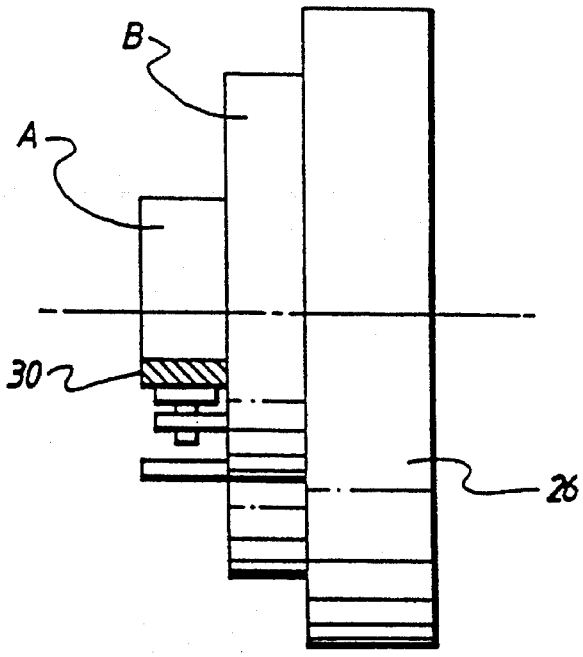
FIG. 2A is a side view of the apparatus of FIG. 1 when in the FIG. 2 position.

In order to use the apparatus to form a metal strip or bar into a scroll, as shown in FIG. 2, the strip 30 is inserted so as to lie at the base of the scroll part A and to enable this to be done, the scroll part B must be axially displaced along with the disc 26 against the action of the spring, as indicated by arrow 32 in FIG. 2 and as shown in FIG. 2A. When the strip is in this position, the shaft 14 can be turned, and the strip 30 can have the first revolution of the scroll formed around the scroll jig part A. The region where scroll part A ends and scroll part B begins is indicated by arrow C in FIG. 1.

Figure 3:
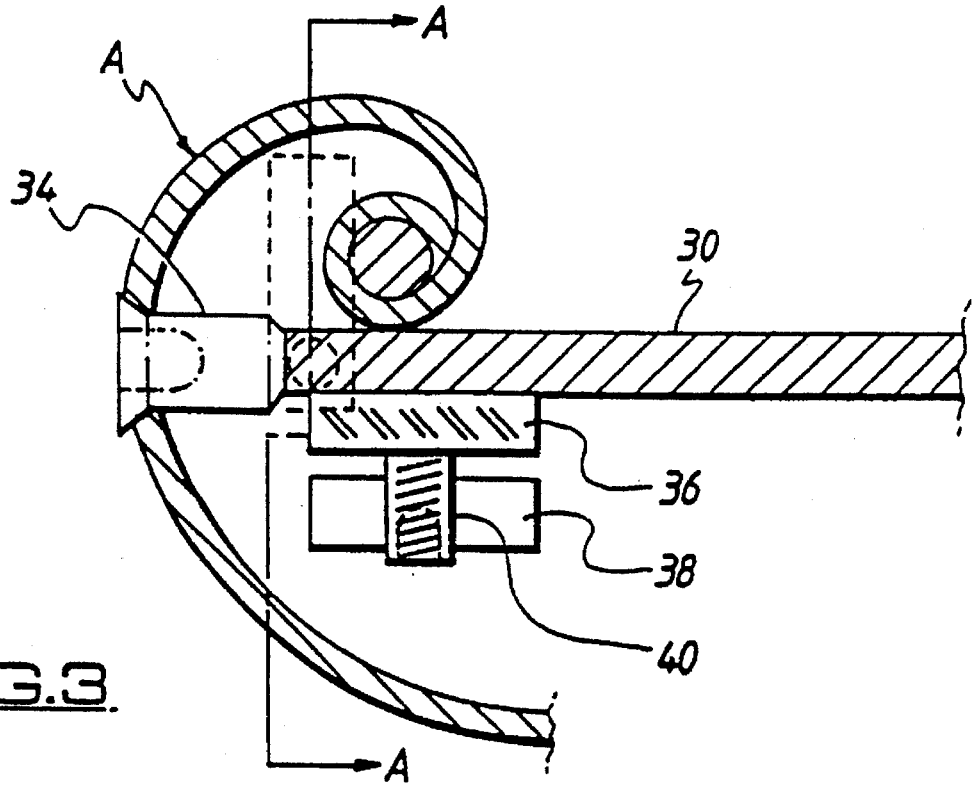
FIG. 3 is a sectional end elevation of the centre portion of the scroll apparatus when in the FIG. 2 position.
Figure 4:
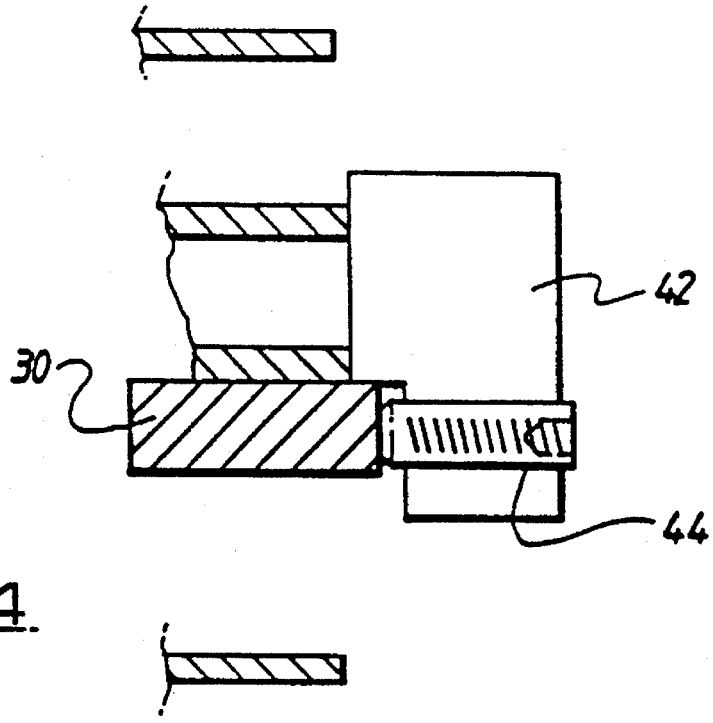
FIG. 4 is a sectional view on the line A—A in FIG. 3.

In order that the end of the strip 30 which is inserted into the scroll jig will be accurately positioned, certain jigging components are provided on or adjacent the inner scroll part A as shown in FIGS. 3 and 4.

Firstly, to limit the extent to which the strip 30 can be inserted into the scroll part A there is a stopping member in the form of grub screw 34 threaded into the scroll part A as shown so that the end of the strip 30 abuts the end of the screw 34, which is to a limited extent adjustable.

Secondly, in order to support the underside of the strip 30 there is a gripping member in the form of a wheel 36 which is carried by a mounting block 38 which is welded to disc 22. The wheel 36 is fast with an adjustment screw 40 which can be adjusted by means of an Allan key. Finally, a further block 42 is welded to the edge of the scroll part A as shown in FIG. 4 and is provided with an adjusting grub screw 44 which adjustably engages the side of the strip 30. When the strip is therefore positioned in the apparatus as shown in FIG. 2, its end will be accurately positioned and fixed so that it will not move during the scrolling operation.

To form the scroll in the strip it is simply now a matter of rotating the shaft 14 and the scroll forms continuously and in single plane as illustrated in FIGS. 5–9 to which reference is now made.

Figure 5:
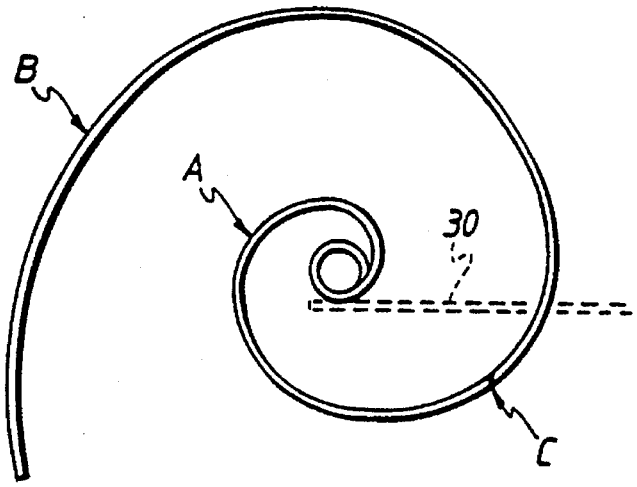
Figure 6:
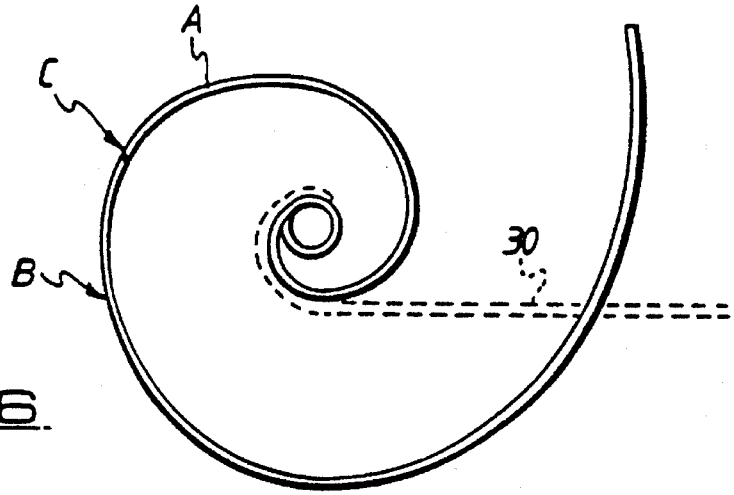
Figure 7:
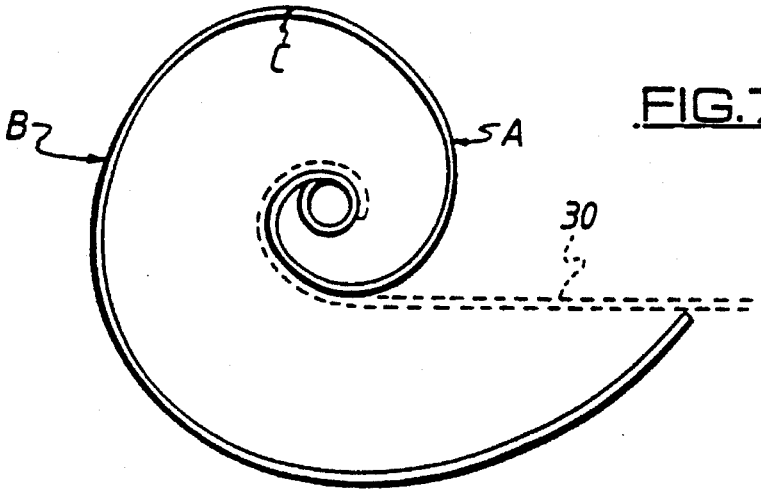

The FIG. 5 position is the same as that shown in FIGS. 2 and 2A. In this position the scroll jig part B is displaced axially relative to the part A so that the parts A and B are in parallel planes as shown in FIG. 2A, the step between the parts being defined at the region C. The strip 30 in fact keeps the part B so axially displaced. Rotation of the shaft 14 causes the scroll to move through the various positions and one position as shown in FIG. 6 indicates that the scroll jig 24 has been rotated and the strip has been partially formed. As the strip 30 still rides on the edge of the outer scroll jig part B, it is maintained axially displaced and the strip can wrap round the part A until the position shown in FIG. 7 is reached. In this position, the part B is now clear of the strip 30 and therefore the scroll jig part B can now spring forwards to the FIG. 1 position. At this stage, the first revolution of the scroll has been formed on the strip 30. Continued rotation of the scroll jig as shown in FIGS. 8 and 9 enables the strip 30 to continue being formed on the scroll jig part A followed by formation of the second revolution of the scroll on jig part B and the complete scroll forms continuously and it lies in single plane at the completion of the formation as indicated in FIG. 9. It is then a matter simply of removing the formed scroll from the jig, and the operation can be repeated for the next and subsequent strips to be so formed.

FIG. 10 shows an alternative arrangement wherein by virtue of axial relative movement between the jig parts and the scroll, the scroll can be formed continuously and in a single plane, but in this arrangement it is not necessary to provide an axially movable scroll jig part. In the arrangement of FIG. 10, the scroll again defines two parts A and B connected by a step C so that in fact the scroll part A is twice the width of the scroll part B. With the arrangement of FIG. 10, the first part of the strip is scrolled in that the strip can be entered into the first part of the scroll over shoulder C and when the first part of the strip is scrolled and passes the end 50 of the scroll part B, the partially formed scroll can be moved axially inwardly so that the remainder can be formed on the inner portion of scroll jig part A, followed by formation on the scroll jig part B. The shoulder C can in fact be in any position which enables this relative movement of the partially formed scroll and the jig to take place, although the position shown in FIG. 10 is preferred as it provides best support arrangement for the front end of the strip to be scrolled. Appropriate mounting and registration devices the same as or similar to those shown in FIGS. 3 and 4 will be provided in the arrangement of FIG. 10 and again any suitable drive arrangement may be provided for rotating the scroll jig of the arrangement shown in FIG. 10.

Although it is desirable to arrange the apparatus according to the embodiments of the invention with the axis of rotation horizontal, it will be appreciated that it may be arranged with the axis in any other disposition. Also, any suitable drive means (including handles, gears, foot mechanisms, and power drives) may be provided for rotating the shaft, and equally it is within the scope of the invention that the shaft is not rotated but that the strip is turned manually or by other means around the scroll jig.

In the formation of strip material such as strip metal into scroll or fancy work, it is frequently required of the operator to be able to perform other operations on strip material such as cutting, riveting, and bending in other configurations such as circular or arcuate or right angle configurations, and therefore it is desirable that a strip working apparatus such as the scroll forming apparatus described herein should be designed and equipped to perform other functions, and this can be achieved with an apparatus as previously described in a simple and effective manner and of which examples are shown in FIGS. 11 and 12.

In the arrangement of FIG. 11, use is made of the disc 26 for the formation of arcuate and circular bending of strip material, and in the arrangement shown in FIG. 11, the apparatus embodies a scroll former as described in relation to FIG. 1, which is mounted on the bench or support surface 10 by means of a mounting frame 60 having a pair of support legs 62, 64 which extend from a boss 66 providing a support for the shaft 14 as hereinbefore described. The support legs 62 and 64 are symmetrically arranged with respect to the vertical plane containing axis 14, and are connected to the bench 10 by angled feet 68 and 70. Attached to the feet 68 and 70 are horizontal support bars 72 and 74 which are parallel, and which in turn support an adjustment shaft 76 provided with right and left hand threaded portions 78 and 80. Threaded on these portions 78 and 80 are nuts 82 and 84 forming end fulcrums of a pair of levers 86 and 88 having free ends which carry deforming rollers 90 and 92 arranged as shown.

A handle 94 at one end of the shaft 76 enables the shaft 76 to be rotated, and therefore the nuts 82 and 84 to move together and apart depending upon the direction of rotation of handle 94. This has the effect of causing the levers 86 and 88 to slide on the top edges of bars 72 and 74 to pivot the levers 86, 88 closer together to move the rollers 90 and 92 towards the axis 14 of the scroll disc 26 or further away from same.

For the deformation of a strip indicated by reference 30 in FIG. 11, the strip is positioned to the underside of the disc 26 in register with the circumferential periphery thereof, and the strip also rests on the rollers 90 and 92, these rollers being arranged in the same plane as the disc 26. It can be seen that by adjustment of the position of the rollers 90 and 92, and by the forwards and reverse rotation of the disc 26 by means of the handle 16, so the strip 30 can be fed back and forth along its length and will be caused to curve to an extent dictated by the amount by which the strip 30 subtends the circumference of the disc 26. To make a circular shape of the strip 30, the rollers are moved eventually into register and contact with the disc 26.

The strip can be curved to any radius down to a minimum equal to the radius of the disc 26.

FIG. 12 shows how the apparatus of FIG. 1 may be fitted with a mechanism for cutting strip, for riveting and punching strip, and for forming right angle bends in strip, and referring to FIG. 12, the handle 16 is shown as being connected to a disc 100 which is eccentrically mounted on the shaft 14, this mechanism being arranged to the opposite side of the disc 26 from the scroll A/B.

Disc 100 locates in a slot 102 of a drive arm 104 which is pivotally mounted on the machine frame at pivot point 106 so that by rotation of handle 16, the drive plate 104 is caused to rock back and forth as indicated by arrow 108. Use is made of this reciprocation motion in order to enable the various functions of this mechanism to be performed.

Firstly, the frame of the apparatus is provided with a slot 110 the lower edge 112 of which forms a guillotine edge in conjunction with the edge 114 of the lever 104. As the handle 16 is rotated so the lever 104 slices past the edge 112 of the slot to the position shown in dotted lines at 116, guillotining the appropriate portion of the strip 30 positioned therein.

At the same time, the reciprocation of the lever 104 causes reciprocation of a punch bar 118 which moves back and forth relative to an abuttment finger 120. Abuttment finger 120 is provided with a punch hole 122 for receiving a punch 124 carried by the punch bar 118. If the strip material is placed between the punch 124 and the hole 122, an appropriate aperture will be punched therein by the reciprocation of the lever 104. The top surface regions 126 and 128 of the punch bar 118 and the finger 120 form riveting surfaces to enable sections of the strip material to be riveted together, and finally right angle bends may be formed in the strip material in that finger 120 is provided with a bending pin 130 which is adapted to engage in a V-shaped slot 132 in the punch bar 118 in order to bend the strip to right angled form.

This mechanism can readily be fitted to the opposite side of the disc 26 from the scroll A/B of the arrangement of FIG. 1.

In a further modification of the arrangement shown in FIG. 1, the apparatus may be adapted for twisting straight bar by locating an end of the bar in a socket aperture 140 (also shown in FIG. 13) lying on the axis of shaft 14 and in the centre of the scroll part A, which operates in conjunction with a saddle (not shown in FIG. 1) spaced from the socket 140 but fixed relative to the table 10 for receiving the other end of the bar. When the other end of the bar is held in the saddle, and the first end is received in the socket 140, turning of the handle 16 effects twisting of the bar.

A machine equipped with all of the functions above described is extremely useful and effective for metal strip bending, cutting, twisting and joining which are the major functions of the work of the decorative iron worker.

The various elements of the machine thus described are in themselves novel and inventive.

FIG. 13 shows a modification for enhancing the scrolling operation, and this modification comprises a support bracket 142 which is fixed relative to the machine frame, and a catch or pressure plate 144 which is hinged to the bracket 142 about pivot point 146.

The top edge of the catch plate 144 is chamfered as shown at 148 and a latch hook 150 is provided at that end. The plate 144 may be biassed to the position shown by a light spring 144A if required.

As can be seen from FIG. 13, when the strip 30 is initially positioned in the scroll, the plate 144 is in a forwardly tilted position and engages the underside of the strip. As rotation of the scroll takes place, so the reactive force on the strip applies pressure on the plate 144 and this keeps the strip in firm contact with the scroll. As rotation proceeds, the strip 30 eventually passes the end of the portion B of the scroll, and the portion B therefore springs forward and its tail engages the catch 150 and flicks the plate 144 to the dotted line position which is outwardly of the scroll but continues to support the strip against the face of the portion B of the scroll ensuring effective support of the strip and the application thereof to the scroll surface.

The apparatus described can be adapted for the scrolling of relatively thick and strong strip material in the order of 5 to 8 mm×40 mm section. Scrolling is simple and effective and generally speaking the equipment of the prior art is not suitable for the scrolling and bending of heavy strip material. In the prior art equipment for the formation by scrolling of heavy strip material it is not uncommon for the strip initially to be heated then forged.

With the scroll device according to the embodiments described, strip material which has been scrolled and in relation to which it is required that it be unscrolled, can be unscrolled simply by reversing the operation of the machine.

As the scroll apparatus according to the embodiments of the invention preferably is for use with the axis of rotation horizontal, it is a simple matter to connect the scroll device to the head stock of a lathe which is another distinguishing feature of the apparatus according to the embodiments as compared to the prior art.

The apparatus described has a number of advantages, particularly the apparatus described in relation to FIG. 1 as it provides automatic scrolling and as described herein can be adapted for making circles and arches. Only a small area is required to enable the apparatus to work, and it is possible to provide three or more discs in order to make larger scrolls i.e. scrolls of more than two rotations. In such arrangement, it may be advantageous to provide a short bridge member to prevent the strip member from slipping into any gap between the second and third stroll sections (or the third and forth scroll sections and so on). Further, depending on the size of the scroll parts A and B and the width of a selected strip or bar, it is possible to place a number of strips in side by side relationship into the scroll so as to provide for the simultaneous production of more than one scroll formed strip. Each strip being of the same size, shape and scroll tension.

I claim:

1. An apparatus for forming a strip of material into a scroll, said apparatus comprising:

a scroll forming jig secured to a shaft and having an axis of rotation;

the scroll forming jig having spirally aligned first and second spiral-shaped scroll forming portions mounted for rotation therewith for forming first and second revolutions of the scroll respectively as the shaft and thereby the jig and scroll forming portions are rotated;

the first and second scroll forming portions being displaceable along the axis of rotation with respect to each other and normally urged into a common plane by a spring means connected to one of the first and second portions whereby the strip of material can be inserted into the first portion at an oblique angle with respect to the axis of rotation to thereafter be swingable into a position perpendicular to the axis of rotation thereby contacting and axially displacing the second portion against the force of the spring means such that the jig can be rotated to begin formation of the first revolution of the scroll around the first portion; and whereby when at least half of the first revolution of the scroll is formed, the second portion has a radial gap therein for accommodating the strip of material and thereby allowing the spring means to return the first and second portions back into the common plane so that the second revolution of the scroll can be formed in a continuous motion with the first revolution of the scroll.

2. The apparatus of claim 1 wherein the first spiral-shaped scroll forming part and the second spiral-shaped scroll forming part are connected at a shoulder.

3. The apparatus of claim 1 wherein the axis of rotation is horizontal.

4. The apparatus of claim 3 wherein a drive means for rotating the first and second portions is included.

5. The apparatus of claim 4 wherein the drive means comprises a manually rotatable handle.

6. The apparatus of claim 5 wherein the drive means includes a reduction gear interposed between the handle and the scroll forming portions.

7. The apparatus of claim 1 wherein the first portion has one end disposed adjacent the axis of rotation and another end disposed remote from the axis of rotation and the second portion has an end aligned with the remote end of the first portion.

8. The apparatus of claim 1 wherein the apparatus includes guide means for guiding the strip of material into the first portion.

9. The apparatus of claim 8 wherein the guide means is movable between a first position adjacent the first portion when the first revolution of the scroll is formed and a second position outwardly of said first position when the second revolution of the scroll is formed.

10. The apparatus of claim 9 wherein the guide means provides reactive support for the strip of material being supplied to the portions.

11. The apparatus of claim 9 wherein the guide means is adapted to be moved to the second position by the guide means coming into contact with the second portion as the second portion moves axially into the common plane with the first portion.

12. The apparatus of claim 11 wherein the guide means is a projection which engages the second spiral-shaped scroll forming part and is rotated to move the guide means to the second position.

13. The apparatus of claim 4 wherein the drive means is provided in connection with a cam operated lever and a cutting edge for guillotining strip material.

14. The apparatus of claim 13 wherein the cam lever is connected to a cutting edge which is reciprocally movable to assert a cutting action on the strip of material.

15. The apparatus of claim 13 wherein the cam operated lever is operably connected to drive a strip material riveter.

16. The apparatus of claim 13 wherein the cam operated lever is drivingly connected to a strip material right angle bender.

17. The apparatus of claim 1 further comprising drive means for rotating the portions whereby the strip of material can be fed radially with respect to the portions and the same drive means is drivingly connected to a means for auxiliary forming the strip of material, the means for auxiliary forming selected from the group consisting of a right angle bender, an arcuate bender, a guillotine, a hole puncher, a riveter, and a twister.

* * * * *